US008598105B2

(12) United States Patent
Miyake et al.

(10) Patent No.: US 8,598,105 B2
(45) Date of Patent: Dec. 3, 2013

(54) LIQUID DETERGENT COMPOSITION

(75) Inventors: Toshio Miyake, Wakayama (JP); Ayumi Watada, Wakayama (JP); Ayako Kita, Wakayama (JP); Kohei Nishida, Wakayama (JP); Kenichi Shiba, Wakayama (JP); Shinichi Inaba, Toyko (JP)

(73) Assignee: Kao Corporation, Tokyo (JP)

( * ) Notice: Subject to any disclaimer, the term of this patent is extended or adjusted under 35 U.S.C. 154(b) by 0 days.

(21) Appl. No.: 13/322,889

(22) PCT Filed: May 27, 2010

(86) PCT No.: PCT/JP2010/058954

§ 371 (c)(1),
(2), (4) Date: Dec. 20, 2011

(87) PCT Pub. No.: WO2010/137635

PCT Pub. Date: Dec. 2, 2010

(65) Prior Publication Data

US 2012/0115768 A1 May 10, 2012

(30) Foreign Application Priority Data

May 29, 2009 (JP) ..... 2009-130608

(51) Int. Cl.
*C11D 1/722* (2006.01)
*C11D 1/02* (2006.01)

(52) U.S. Cl.
USPC ..... 510/360; 510/361; 510/421; 510/426; 510/475; 510/477; 510/492; 510/505

(58) Field of Classification Search
USPC ..... 510/360, 361, 421, 426, 475, 477, 492, 510/505
See application file for complete search history.

(56) References Cited

U.S. PATENT DOCUMENTS

| | | | | |
|---|---|---|---|---|
| 4,814,102 | A | 3/1989 | Baur et al. | |
| 4,897,215 | A | 1/1990 | Trieselt et al. | |
| 6,048,831 | A | 4/2000 | Mori et al. | |
| 6,835,708 | B2 * | 12/2004 | Saeki et al. | 510/531 |
| 2011/0224126 | A1 | 9/2011 | Miyake et al. | |

FOREIGN PATENT DOCUMENTS

| | | | | |
|---|---|---|---|---|
| EP | 0299691 | A1 | 1/1989 | |
| JP | 10-60476 | A | 3/1998 | |
| JP | 10-060496 | A | 3/1998 | |
| JP | 2001-334139 | * | 12/2001 | B01F 17/42 |
| JP | 2001-334139 | A | 12/2001 | |
| JP | 2003-105377 | * | 4/2003 | C11D 1/722 |
| JP | 2003-105377 | A | 4/2003 | |
| JP | 2003-226892 | A | 8/2003 | |
| JP | 2004-155937 | A | 6/2004 | |
| JP | 2005-187742 | A | 7/2005 | |
| JP | 2008-7705 | A | 1/2008 | |
| JP | 2008-7706 | A | 1/2008 | |
| JP | 2008-7707 | A | 1/2008 | |
| WO | WO 98/23712 | A2 | 6/1998 | |
| WO | WO 98/24865 | A1 | 6/1998 | |
| WO | WO 2010/058862 | A1 | 5/2010 | |

OTHER PUBLICATIONS

International Search Report, PCT/JP2010/058954, Aug. 10, 2010.
International Preliminary Report on Patentability and English translation of the Written Opinion of the International Searching Authority, for Application No. PCT/JP2010/058954, dated Dec. 12, 2011.
Computer-Generated English Translation of JP-10-60496-A, published Mar. 3, 1998.
Computer-Generated English Translation of JP-2001-334139-A, published Dec. 4, 2001.
Computer-Generated English Translation of JP-2003-105377-A, published Apr. 9, 2003.
Computer-Generated English Translation of JP-2003-226892-A, published Aug. 15, 2003.
Notification of First Office Action for corresponding Chinese Patent Application No. 201060023537.X, dated Aug. 29, 2012.
Extended European Search Report, dated May 17, 2013, for European Application No. 10780589.7.

* cited by examiner

*Primary Examiner* — Brian P Mruk
(74) *Attorney, Agent, or Firm* — Birch, Stewart, Kolasch & Birch, LLP

(57) ABSTRACT

The present invention provides a liquid detergent composition containing a specific amount of surfactant (A); a specific amount of a polymer compound (B) having the polyether chain moiety (i) and the polymer chain moiety (ii) composed of polymerization units derived from the specific unsaturated monoethylenic monomer; and water, wherein component (A) contains a specific amount of a specific alkoxyl nonionic surfactant (a1), and component (B) is a polymer compound having the polyether chain moiety (i) composed of polymerization units derived from an epoxide having 2 to 5 carbon atoms and the polymer chain moiety (ii) composed of polymerization units derived from one or more unsaturated carboxylic acid monomers selected from acrylic acid, methacrylic acid and maleic acid, the polymer compound having a graft structure wherein one of the chain moieties (i) and (ii) is the main chain and the other is a side chain.

17 Claims, No Drawings

LIQUID DETERGENT COMPOSITION

FIELD OF THE INVENTION

The present invention relates to a liquid detergent composition, and particularly to a liquid detergent composition for fiber products such as clothing.

BACKGROUND OF THE INVENTION

Recent increase in the environmental consciousness leads strong desire for the development of a detergent with low environmental load. A detergent having higher concentration of a cleaning component than that of conventional detergent, or a concentrated detergent, appears as being very effective for decreasing its own size to reduce an amount of resin used for container, a transportation cost, a waste after use, and the like, resulting in reduction of loads on the environments.

Such a surfactant-rich liquid detergent composition however has problems of difficulty in stably blending a builder component in addition to storage stability of the composition itself. For example, polyacrylic acid polymers are known to have good properties of dispersing mud and preventing redeposition of the mud. These polymers are generally difficult to be stably blended in an aqueous surfactant system. In some cases, an aqueous surfactant system blended with a polyacrylic acid polymer causes clouding, separation such as phase separation, and/or precipitation of a base material in the solid form in a solution during storage.

In addition, when a concentration of the surfactant that is a cleaning ingredient of a liquid detergent is increased, the liquid detergent tends to cause thickening and/or gelation. To control thickening and/or gelation, there is a method of adding a large amount of organic solvent to such a liquid detergent to decrease a water content. The method however has a dissolution problem by formation of liquid crystals due to dilution with water in washing.

JP-A 2008-7705, JP-A 2008-7706 and JP-A 2008-7707 describe concentrated liquid detergent compositions containing a specific nonionic surfactant. These compositions still have a problem of solubility in water. There is no suggestion about stable blending of a polymer.

JP-A 10-60476 and JP-A 10-60496 describe liquid detergents containing a polymer produced by graft polymerization of a polyether compound such as polyethylene glycol as the main chain with a monoethylenic monomer component mainly composed of acrylic acid or methacrylic acid. These prior patents disclose concentrated surfactant systems, but do not consider the dissolution problem during dilution.

JP-A 2004-155937 describes a polymer having two segments for dispersing a nonionic surfactant and a water-insoluble solid matter, where the nonionic surfactant is salted-out by addition of a large amount of water-soluble inorganic salt. The patent discloses a concentrated and solid-dispersed liquid detergent containing a polymer of a polyethylene glycol acrylate and acrylic acid as the polymer having two segments. The patent relates to a technique of stably dispersing droplets of the nonionic surfactant accompanied with the water-insoluble solid matter in an aqueous phase prepared as having a high salt concentration in the liquid detergent of multi-phase, not in a uniform system.

JP-A 2005-187742 discloses a surfactant composition containing a nonionic surfactant prepared by addition of EO and PO, a polymer, and a water-soluble inorganic salt dispersed in the composition. U.S. Pat. No. 4,814,102 and U.S. Pat. No. 4,897,215 disclose detergents containing a copolymer prepared from a monomer having a carboxyl group and a monomer having a polyglycol group. WO-A98/023712 discloses a surfactant composition containing a nonionic surfactant, prepared by addition of EO and PO, and a polymer.

SUMMARY OF THE INVENTION

The present invention relates to a liquid detergent composition, containing a surfactant (A) [hereinafter, referred to as component (A)] in an amount of 40 to 80% by mass; a polymer compound (B) described below [hereinafter, referred to as component (B)] in an amount of 0.3 to 8% by mass; and water, wherein component (A) contains a nonionic surfactant (a1) [hereinafter, referred to as component (a1)] represented by formula (1) in an amount of 30 to 70% by mass of the composition:

component (a1): a nonionic surfactant represented by formula (1)

$$R^1O—(C_2H_4O)_m/(A'O)_nH \quad (1)$$

wherein, $R^1$ represents a hydrocarbon group having 8 to 22 carbon atoms; A'O represents an oxyalkylene group having 3 to 5 carbon atoms; m and n each represent an average addition mole number, m is a number of 16 to 30 and n is a number of 1 to 5; "/" defines that $C_2H_4O$ group and A'O group are linked either randomly or in blocks of the respective groups.

component (B): a polymer compound having a polyether chain moiety (i) composed of polymerization units derived from an epoxide having 2 to 5 carbon atoms and a polymer chain moiety (ii) composed of polymerization units derived from one or more unsaturated carboxylic acid monomers selected from acrylic acid, methacrylic acid and maleic acid, the polymer compound having a graft structure wherein one of the chain moieties (i) and (ii) is the main chain and the other is a side chain.

The present invention also relates to a liquid detergent article, obtained by filling a plastic container including a receptacle part of the liquid detergent composition, wherein the receptacle part is composed of a plastic having a flexural modulus of 2000 MPa or more (JIS K7171) and has a thickness of 0.3 to 1.5 mm, with the liquid detergent composition.

The present invention also provides use of the composition as a liquid detergent.

DETAILED DESCRIPTION OF THE INVENTION

The present invention provides the liquid detergent composition containing the polymer compound (hereinafter, may also be referred to as a polymer builder) and a surfactant with an increased concentration, that retains storage stability and solves the problem of decreased solubility due to gelation or the like when diluted with water. The present invention also solves a problem of deformation of the container occurring during storage of the liquid detergent article, produced by filling the container with the liquid detergent composition containing the polymer compound and a surfactant at an increased concentration.

As used herein, the "polymerization unit" refers to a structural unit in the polymer compound corresponding to one monomer.

According to the present invention, the liquid detergent composition containing the polymer builder and a surfactant with an increased concentration is provided, that retains storage stability and exhibits no reduction of solubility due to gelation or the like when diluted with water. The liquid detergent article produced by filling the liquid detergent composition in the container also has good storage stability and exhibits no deformation of the container during storage.

<Component (A)>

The liquid detergent composition of the present invention contains a surfactant, which contains component (a1) as an essential component.

Below, component (a1) will be described.

In the description, —$(C_2H_4O)_m/(A'O)_nH$ of formula (1) is also represented as -$(AO)_xH$. In this representation, alkylene oxide groups $(AO)_x$ must include an ethylene oxide group, and x=m+n.

In formula (1) representing component (a1), $R^1$ represents a hydrocarbon group having preferably 8 to 22 carbon atoms, more preferably 10 to 16 carbon atoms, and even more preferably 10 to 14 carbon atoms, and also preferably represents a linear hydrocarbon group. The hydrocarbon group as $R^1$ is preferably an alkyl or alkenyl group, and more preferably an alkyl group. $R^1$ preferably represents a linear or branched alkyl group, and more preferably a linear alkyl group.

In -$(AO)_xH$, an average addition mole number of alkylene oxide having 2 to 5 carbon atoms x is 17 to 35. When x is 17 or more, the composition can be sufficiently prevented from forming liquid crystals to decrease solubility when diluted with water. When X is 35 or less, the composition has good stability. The number x is preferably 17 to 30, and more preferably 18 to 25. The compound of formula (1) has oxyethylene groups as AO in an average amount of 11 mol or more, preferably 13 mol or more, and more preferably 15 mol or more. All of AOs may be oxyethylene groups. The number x may correspond to a reaction ratio of the alkylene oxide having 2 to 5 carbon atoms to an alcohol represented by $R^1OH$ in production of component (a1).

Respective compounds constructing component (a1) preferably meet conditions such that compounds having an AO addition mole number from 0 to 5 account for 0 to 6% by mole of the total compounds constructing component (a1) and compounds having an AO addition mole number 50 or more (and 70 or less according to measuring conditions and the like) account for 0 to 5% by mole of the total compounds. In cases of using together with a polyoxyalkylene alkyl ether nonionic surfactant having an average addition mole number outside the range of x, if a mixture of this nonionic surfactant with component (a1) satisfies conditions for formula (1), then the nonionic surfactant is also included in component (a1). In this case, the mixture preferably satisfies distribution conditions for AO addition mole number described above.

The compound represented by formula (1) can be prepared by random or block addition of ethylene oxide and an alkylene oxide having 3 to 5 carbon atoms to an alcohol having 8 to 22 carbon atoms.

In formula (1), m is an average added mole number of ethylene oxide. From the viewpoints of storage stability, solubility, and washing performance, the lower limit is 16 or more, and the upper limit is 27 or less, and more preferably 24 or less. In formula (1), n is an average added mole number of an alkylene oxide having 3 to 5 carbon atoms. From the viewpoint of washing performance, the lower limit is 1 or more, and preferably 2 or more, and the upper limit is 5 or less, and preferably 4 or less.

In formula (1), an oxyalkylene group represented as A'O is produced by addition of an alkylene oxide having 3 to 5 carbon atoms. A bonded moiety by the addition has a methyl- or propyl-blanched structure. A'O is preferably an oxypropylene group (hereinafter, may also be referred to as PO) produced by addition of propylene oxide.

In the present invention, particularly preferably used is a compound having a propylene oxide average addition mole number n of 1 to 4, and more preferably 2 to 4 and having an ethylene oxide average addition mole number m of 15 to 27, and more preferably 16 to 24, for producing the liquid detergent composition having good storage stability, solubility, and washing performance.

In formula (1), "/" shows that oxyethylene group ($C_2H_4O$, hereinafter may also be referred to as EO) and AO group are linked either randomly or in blocks of the respective groups, and may be arranged as follows:

$R^1O$-$(A'O)_n$-$(EO)_mH$ (1-1-1)

$R^1O$-$(EO)_m$-$(A'O)_nH$ (1-1-2)

$R^1O$-$[(EO)_{m1}\bullet(A'O)_n]$-$(EO)_{m2}H$ (1-1-3)

$R^1O$-$(EO)_{m1}$-$[(A'O)_n.(EO)_{m2}]H$ (1-1-4)

$R^1O$-$(EO)_{m1}$-$(A'O)_n$-$(EO)_{m2}H$ (1-1-5)

wherein, $R^1$, m, n, ED, and A'O represent the same meanings as above; m1 and m2 each represent an average addition mole number and m=m1+m2; and "." represents that (A'O) and (EO) are linked randomly. n of A'O groups may be divided into blocks. Compounds represented by formulae (1-1-1) to (1-1-5) can be prepared from $R^1OH$ and alkylene oxides in view of the reaction ratio and the reaction order.

For an oxygen-bonding carbon atom of $R^1$ in $R^1$—O— of formula (1), a compound in which the carbon atom is primary has better detergency than a compound in which the carbon atom is secondary. $R^1$ is particularly preferably a linear alkyl group having an oxygen-bonding primary carbon. When an oxygen-bonding carbon atom of $R^1$ is primary, from the point of storage stability, preferred are compounds represented by formulae (1-1-2), (1-1-4), and (1-1-5), and more preferred are compounds represented by formula (1-1-5). Of compounds constructing component (a1), a percentage of compounds having an oxyethylene group as the oxyalkylene group bonding to $R^1$—O—, or having $R^1$—O-EO— is particularly preferably 75% by mol or more, and more preferably 80% by mol or more (the upper limit is 100% by mol). Such a compound can be produced by initially adding ethylene oxide to an aliphatic alcohol and removing the unreacted alcohol or by initially adding ethylene oxide in an amount of 6 mol or more, and particularly 8 mol or more. For example, the compound is represented by formula (1-1-2), (1-1-4) or (1-1-5) in which an average addition mole number m in (1-1-2) or ml in (1-1-4) or (1-1-5) is 6 moles or more, more preferably 8 moles or more.

For increasing stability, a percentage of compounds having the structure -EO-H at the end thereof in formula (1) is preferably 70% by mol or more, and more preferably 80% by mol or more (the upper limit is 100% by mol). When the percentage is equal to or higher than the value, the composition has better stability at low temperature. Such a compound can be produced by finally adding only ethylene oxide in an amount of 6 mol or more, more preferably 8 mol or more, after the step of addition of an alkylene oxide having 3 to 5 carbon atoms, preferably propylene oxide, to provide A'O in production of a compound having formula (1). For example, the compound is represented by formula (1-1-3) or (1-1-5) in which an average addition mole number m2 in (1-1-3) or (1-1-5) is 6 moles or more, more preferably 8 moles or more.

In the present invention, a particularly preferred compound has formula (1) in which $R^1$ represent a linear alkyl group having an oxygen-bonding primary carbon and satisfies conditions of percentage by mole about $R^1$—O-EO- and -EO-H described above. In the present invention, percentages of $R^1$—O-EO- and -EO-H can be quantitatively determined by $C^{13}$-NMR.

An amount of component (a1) used in the composition is 30 to 70% by mass, and preferably 40 to 60% by mass. When component (a1) is a compound having a linear alkyl rate of $R^1$ of 90% or more, and particularly substantially 100%, the amount of component (a1) used in the composition is preferably 40 to 60% by mass. As used herein, the linear alkyl rate (%) of component (a1) refers [a mole number of compounds having a linear alkyl group in component (a1)]/[the total mole number of component (a1)]×100. The present invention can achieve detergency without causing gelation in dilution with water for washing even when the surfactant is used at high concentration.

From the point of solubility at a low temperature, component (A) preferably contains an anionic surfactant (a2) [hereinafter, referred to as component (a2)], in addition to component (a1). The presence of component (a2) is more preferable for stably blending component (B) and increasing detergency against skin oil stains without affecting prevention of mud's re-deposition.

A content of component (a2) preferably satisfies a ratio described below in relation with component (a1).

Examples of the anionic surfactant used include (a2)-1 to (a2)-5 described below. For stably blending component (B) and achieving good washing performance and solubility, component (a2) preferably contains (a2)-1, (a2)-2, and (a2)-4, and more preferably (a2)-1. When component (a2) contains (a2)-1, an amount of the (a2)-1 is preferably 80% by mass or more, and particularly preferably 90% by mass of component (a2) for stably blending component (B) and achieving good washing performance and solubility. When (a2)-4 is contained as a foaming modifier, from the point of low temperature stability, (a2)-4 preferably accounts for 1 to 30% by mass, and more preferably 1 to 20% by mass of component (a2).

(a2)-1: alkylbenzenesulfonic acid salt having an alkyl group of average carbon number of 10 to 20

(a2)-2: polyoxyethylene alkyl ether sulfuric acid ester salt having an average addition mole number of 1 to 5, that has an alkyl group of average carbon number of 10 to 20 derived from a linear primary or secondary alcohol or a branched alcohol and has oxyethylene groups one or two of which may be substituted with oxypropylene groups (a2)-3: alkyl- or alkenylsulfuric acid ester salt having an alkyl or alkenyl group of average carbon number of 10 to 20

(a2)-4: fatty acid salt of average carbon number of 8 to 20

(a2)-5: polyoxyethylene alkyl ether carboxylic acid salt having an average addition mole number of 1 to 5, that has an alkyl group of average carbon number of 10 to 20 derived from a linear primary or secondary alcohol or a branched alcohol and has oxyethylene groups one or two of which may be substituted with oxypropylene groups Examples of a salt composing component (a2) include alkaline metal salts such as of sodium and potassium, alkanolamine salts, and alkaline earth metal salts such as of magnesium and calcium. Particularly from the point of stability, the salt is preferably an alkanolamine salt. The anionic surfactant may be added in an acid form and neutralized with an alkali in the liquid detergent. In the present invention, component (a2) is preferably in an alkanolamine salt form, or added in an acid form and neutralized with an alkanolamine [that used as an alkaline agent of component (E) described below]. Metal counter ions such as alkaline metal and alkaline earth metal ions may be contained in the composition through the production of component (a1) or as a salt of a sequestering agent or other anionic compound, but preferably at a low concentration, substantially 5% by mass or less, more preferably 3% by mass or less, and even more preferably 0.5% by mass or less, from the point of the storage stability.

For stably blending component (B) and achieving good washing performance against skin oil, in the liquid detergent composition of the present invention, the total content of the components (a1) and (a2), (a1)+(a2) is preferably 40% by mass or more, and more preferably 50% by mass or more, and also preferably 80% by mass or less, and more preferably 70% by mass or less.

Since the anionic surfactant of component (a2) varies its mass according to a molecular weight of a salt formed, the present invention considers a mass of the anionic surfactant not in a salt form but in an acid form, or having a hydrogen atom as a counter ion as the mass of component (a2).

For stably blending component (B) and achieving good washing performance against skin oil and good solubility, in the liquid detergent composition of the present invention, a mass ratio of the components (a1) to (a2), (a1)/(a2), is preferably 25/75 to 90/10, more preferably 50/50 to 85/15, and even more preferably 55/45 to 80/20. From the point of washing performance against skin oil, the ratio of the components (a1) to (a2) is preferably the lower limit or more. For stably blending component (B) and achieving good washing performance against skin oil and good solubility, the ratio is preferably the upper limit or less. The combination use of the components (a1) and (a2) enables to enhance washing performance against skin oil of the composition and increase solubility of the composition by preventing formation of liquid crystals.

The liquid detergent composition of the present invention can contain a surfactant other than the components (a1) and (a2) within the range that does not impair the effects of the present invention. Examples of the other surfactant include the following (a3) to (a5).

(a3) nonionic surfactant not corresponding to component (a1) [hereinafter, referred to as component (a3)]

Examples of the nonionic surfactant (a3) include the following (a3)-1 to (a3)-3, and the like.

(a3)-1: alkylpolysaccharide surfactant represented by the formula:

$$R^{31}—(OR^{32})_{x'}G_{y'},$$

wherein, $R^{33}$ represents a chain hydrocarbon group having 8 to 18 carbon atoms, preferably an alkyl group; $R^{32}$ represents an alkylene group having 2 to 4 carbon atoms; G represents a residue derived from a reducing sugar having 5 or 6 carbon atoms, and preferably from glucose; x' represents an average number of 0 to 6; and y' represents an average number of 1 to 10, and preferably from 2 to 4.

(a3)-2: fatty acid alkanolamide having an alkyl group of 7 to 21 carbon atoms or ethylene oxide-adduct thereof, or polyhydroxyfatty acid amide.

(a3)-3: polyglyceryl (average polymerization degree of 2 to 5) monoalkyl ether having an alkyl group of 8 to 22 carbon atoms.

(a4) cationic surfactant [hereinafter, referred to as component (a4)]

Examples of the cationic surfactant include primary to tertiary amines having a long-chain alkyl group (excluding the alkanolamine described below). The amine has one or two alkyl groups of 8 to 22 carbon atoms that may preferably be interrupted by an ether bond, an ester bond or an amide bond, and has the rest group(s) each of which is a hydrogen atom or an alkyl group of 4 or less carbon atoms that may have a hydroxy group. In the present invention, preferred are quaternary ammonium surfactants having one long-chain alkyl group of 8 to 22 carbon atoms and tertiary amines having one long-chain alkyl group of 8 to 22 carbon atoms.

(a5) amphoteric surfactant [hereinafter, referred to as component (a5)]

Examples of the amphoteric surfactant include sulfobetaines and carbobetains having an alkyl group of 10 to 18 carbon atoms.

A content of the components (a3) to (a5) in the liquid detergent composition of the present invention is preferably 0.5% by mass or more, more preferably 1% by mass or more, and even more preferably 2% by mass or more, and also preferably 15% by mass or less, more preferably 10% by mass or less, and even more preferably 8% by mass or less. Among the components (a3) to (a5), component (a3) is preferably used in an amount such that a mass ratio of the total of the components (a1) and (a3) to (a2), [(a1)+(a3)]/(a2), is within the range described for (a1)/(a2). For the quaternary ammonium salt, in the present invention, the mass of the quaternary ammonium salt is taken without a counter ion. For the tertiary amine, in the present invention, the mass of the tertiary amine is taken as a structure derived from the tertiary amine by replacing groups other than an organic group bonding to the nitrogen atom by hydrogen atoms.

From the viewpoints of washing performance, stability, and solubility, in the liquid detergent composition of the present invention, a content of component (A) is 40 to 80% by mass in the composition. The lower limit is preferably 50% by mass, more preferably 60% by mass. The upper limit is preferably 75% by mass.

<Component (B)>

Component (B) is a polymer compound having a polyether chain moiety (i) [hereinafter, referred to as chain moiety (i)] composed of polymerization units including a unit derived from an epoxide having 2 to 5 carbon atoms and a polymer chain moiety (ii) [hereinafter, referred to as chain moiety (ii)] composed of polymerization units derived from one or more unsaturated carboxylic acid monomers selected from acrylic acid, methacrylic acid, and maleic acid, having a graft structure wherein one of the chain moieties (i) and (ii) is the main chain and the other is a side chain.

Component (B) is more preferably a polymer compound having a side chain that is a polyether chain composed of polymerization units derived from an epoxide having 2 to 5 carbon atoms or a polymer chain composed of polymerization units derived from one kind or more of unsaturated carboxylic acid monomer selected from acrylic acid, methacrylic acid and maleic acid, excluding the chain end. Component (B) is particularly preferably a polymer compound satisfying the side chain condition and having a main chain that is a polyether chain composed of polymerization units derived from an epoxide having 2 to 5 carbon atoms or a polymer chain composed of polymerization units derived from one or more unsaturated carboxylic acid monomers selected from acrylic acid, methacrylic acid and maleic acid, excluding a polymerization unit linked to a side chain and the chain end.

The chain moiety (i) is a polyether chain composed of polymerization units including a unit derived from an epoxide having 2 to 5 carbon atoms, and preferably one kind or more of unit derived from an epoxide having an epoxy group such as ethylene oxide, propylene oxide, and glycidyl ether (e.g., methylglycidyl ether, ethylglycidyl ether). From the viewpoint of storage stability, an average polymerization degree of the chain moiety (i) is, when it is the main chain, preferably 10 to 100, more preferably 15 to 80, including the polymerization unit at which the side chain is linked. When it is the side chain, it is preferably 10 to 100, more preferably 15 to 80 per side chain. The chain end of the chain moiety (i) may be a hydroxy group which may be capped with methyl group, phenyl group or benzyl group.

From the viewpoint of stability, the chain moiety (i) is particularly preferably a polyoxyalkylene chain, and more preferably based on a polyoxyalkylene chain composed of polymerization units including a unit derived from ethylene oxide and/or propylene oxide, and particularly from ethylene oxide. In this case, an average addition mole number of alkylene oxide is, when the chain moiety (i) is the main chain, preferably 10 to 100, more preferably 15 to 80, and even more preferably 19 to 30, including the polymerization unit at which the side chain is linked, and when the chain moiety (i) is the side chain, preferably 10 to 100, more preferably 15 to 80, and even more preferably 19 to 30 per side chain. The polymer compound having an average addition mole number of 10 or more exhibits good stability at ambient temperature or higher, and the polymer compound having an average addition mole number of 100 or less exhibits good low temperature stability.

The chain moiety (ii) is composed of polymerization units including a unit derived from one kind or more of unsaturated carboxylic acid monomer selected from acrylic acid, methacrylic acid and maleic acid. In the present invention, a polymerization unit derived from a maleic acid monomer includes one formed via maleic anhydride. The chain moiety (ii) can contain a polymerization unit derived from an unsaturated monoethylenic monomer other than the unsaturated carboxylic acid monomer. Other polymerization unit is preferably derived from a nonionic monomer or an anionic monomer. For example, the chain moiety (ii) may contain other polymerization unit derived from unsaturated carboxylic acid other than that described above. Examples of an unsaturated carboxylic acid to use together with acrylic acid, methacrylic acid and/or maleic acid, include fumaric acid and itaconic acid. Examples of other polymerization unit also include one derived from unsaturated alcohol monomers such as allyl alcohol. In the present invention, particularly when the chain moiety (ii) is the main chain, component (B) can be produced using the followings as a monomer having the chain moiety (i):

adducts of an epoxide having 2 to 5 carbon atoms to unsaturated ethylenic monomers such as unsaturated alcohol and unsaturated carboxylic acid monomers, or adducts of polyalkylene glycol, of which a polymerization unit is an oxyalkylene having 2 to 5 carbon atoms, to unsaturated ethylenic monomers such as unsaturated alcohol and unsaturated carboxylic acid monomers.

Hereinafter, the monomer having the chain moiety (i) may also be referred to as macromonomer.

In the chain moiety (ii), a percentage of polymerization units derived from one kind or more of unsaturated carboxylic acid selected from acrylic acid, methacrylic acid and maleic acid is, when the chain moiety (ii) is a side chain, preferably 80 to 100% by mole, and more preferably 90 to 100% by mole of the total polymerization units composing the side chain. Particularly preferably, the side chain is substantially composed of polymerization units all derived from the unsaturated carboxylic acid. When the chain moiety (ii) is the main chain, a percentage of polymerization units derived from one or more unsaturated carboxylic acids selected from acrylic acid, methacrylic acid and maleic acid is preferably 80 to 100% by mole, more preferably 90 to 100% by mole, of the total polymerization units of the main chain, excluding the polymerization unit linked to the side chains. The main chain is, even more preferably, substantially entirely composed of polymerization units derived from the unsaturated carboxylic acid.

Component (B) of the present invention is a polymer compound having a graft structure composed of the chain moieties (i) and (ii), one of which is the main chain and the other is a side chain. For producing such a polymer compound, there are methods of, for example, (1) separately forming polymer chains as the main chain and a side chain and grafting these chains, (2) subjecting monomers to graft polymerization on a polymer chain as the main chain to form a side chain, (3) copolymerizing a monomer for the main chain with a monomer having a polymer chain as a side chain, and the like.

<Compound Having the Chain Moiety (i) as the Main Chain>

The polymer compound of the present invention having the chain moiety (i) as the main chain can be produced according to a method of production described in JP-A No. 55-71710 or JP-A No. 59-62614. For example, to a polyether compound can be separately and slowly added one kind or more of unsaturated carboxylic acid monomer selected from acrylic, methacrylic, and maleic acids and an initiator dropwise at 90° C. or higher, and preferably between 100 and 200° C. under nitrogen flow while stirring the polyether compound to obtain a polymer compound in an acid form, that is component (B) of the present invention. The polymer compound can be easily converted to a salt form by neutralizing the cooled compound with an alkaline agent such as sodium hydroxide. The polymer compound may also be added in an acid form and neutralized in the composition in the same way as in the anionic surfactant.

Component (B) of the present invention can be a polymer compound having a polyether main chain subjected to graft polymerization with unsaturated monoethylenic monomers including one kind or more of unsaturated carboxylic acid monomer selected from acrylic acid, methacrylic acid and maleic acid. For producing such a polymer compound by the method described above, preferably used is a polyether compound represented by formula (B1):

$$Y—O(CH_2CH_2O)_nH \quad (B1)$$

wherein, Y represents a hydrogen atom, a methyl group, a phenyl group, or a benzyl group, and preferably a methyl or phenyl group; and, n is an average added mole number of 10 to 100.

When the polymer compound as component (B) has the chain moiety (i) as the main chain and the chain moiety (ii) as a side chain, a percentage of polymerization units derived from an epoxide having 2 to 5 carbon atoms in the chain moiety (i) is preferably 40 to 99% by mass, more preferably 50 to 90% by mass, and even more preferably 60 to 85% by mass per unit mass of the polymer compound. A percentage of polymerization units derived from one kind or more of unsaturated carboxylic acid monomer selected from acrylic, methacrylic, and maleic acids in the chain moiety (ii) is preferably 1 to 60% by mass, more preferably 10 to 50% by mass, and even more preferably 15 to 40% by mass per unit mass of the polymer compound.

<Compound Having the Chain Moiety (ii) as the Main Chain>

The polymer compound having the chain moiety (ii) as the main chain can be produced according to a method of production described in, for example, JP-A 2003-20788. For example, to a polyether compound as a polymerization solvent can be separately and slowly added one kind or more of unsaturated carboxylic acid monomer selected from acrylic, methacrylic, and maleic acids, a monomer having the chain moiety (i), and an initiator dropwise at 50° C. or higher, and preferably at 60° C. or higher under nitrogen flow while stirring to obtain the polymer compound of the present invention in an acid form. The polymer compound can be easily converted to a salt form by neutralizing the cooled compound with an alkaline agent such as sodium hydroxide. The polymer compound may also be added in an acid form and neutralized in the composition in the same way as the anionic surfactant.

As described above, component (B) of the present invention can be produced by copolymerizing a monomer previously attached with the chain moiety (i) (macromonomer) with unsaturated monoethylenic monomer(s) including one kind or more of unsaturated carboxylic acid monomer selected from acrylic, methacrylic, and maleic acids, or by adding a polymerizable monomer such as an alkylene oxide (e.g., ethylene oxide) and glycidyl ether to a polymerized unsaturated monoethylenic monomers including one more unsaturated carboxylic acid monomers selected from acrylic acid, methacrylic acid and maleic acid. In the present invention, component (B) is preferably produced by the former method. The chain moiety (ii) is more preferably composed of polymerization units derived from one more unsaturated carboxylic acid monomers selected from acrylic acid, methacrylic acid and maleic acid and polymerization units derived from a macromonomer in which the epoxide having 2 to 5 carbon atoms corresponding to the chain moiety (i) is added to an unsaturated ethylenic monomer such as an unsaturated alcohol or an unsaturated carboxylic acid; or polymerization units derived from a macromonomer in which polyalkylene glycol having the polymerization unit of an oxyalkylene having 2 to 5 carbon atoms is added to an unsaturated ethylenic monomer such as an unsaturated alcohol or an unsaturated carboxylic acid.

When the polymer compound as component (B) has the chain moiety (ii) as the main chain and the chain moiety (i) as a side chain, a percentage of polymerization units derived from an epoxide having 2 to 5 carbon atoms in the chain moiety (i) is preferably 30 to 98% by mass, and more preferably 40 to 89% by mass per unit mass of the polymer compound. A percentage of polymerization units derived from one kind or more of unsaturated carboxylic acid monomer selected from acrylic acid, methacrylic acid and maleic acid in the chain moiety (ii) is preferably 1 to 60% by mass, more preferably 10 to 50% by mass, and even more preferably 15 to 40% by mass per unit mass of the polymer compound. In this case, a polymerization unit at which a side chain is linked and a polymerization unit at the chain end are not included in polymerization units derived from one kind or more of unsaturated carboxylic acid monomer selected from acrylic acid, methacrylic acid and maleic acid.

As component (B) of the present invention, from the point of storage stability, preferred is the polymer compound having the chain moiety (ii) as the main chain and the chain moiety (i) as a side chain. Particularly from the viewpoints of stability, and in particular pH stability, component (B) is preferably a polymer compound composed of two polymerization units represented by formula (B2), which may be any of random, alternating, and block polymers. The polymer compound has the chain moiety (ii) as the main chain and the chain moiety (i) represented by formula (B3) as a side chain in the structure of the main chain.

[Chemical formula 1]

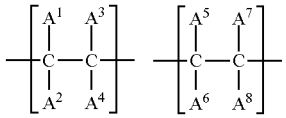

(B2)

wherein, $A_1$ represents a hydrogen atom; $A_2$ represents a hydrogen atom or —$COOX_1$, and preferably a hydrogen atom; $A_3$ represents a hydrogen atom or a methyl group; $A_4$ represents —$COOX_2$; with the proviso that the total number of carbon atoms in $A_1$, $A_2$ and $A_3$ is 0 or 1; $X_1$ and $X_2$ specifically, each independently or at the same time represent a hydrogen atom, a mono- or divalent metal atom, an ammonium group, or an organic amine group; $A_5$ represents a hydrogen atom; $A_6$ represents a hydrogen atom or —$COOX_1$, and preferably a hydrogen atom; $A_7$ represents a hydrogen atom or a methyl group; $A_6$ represents —COO—Z or —$CH_2$—O—Z; with the proviso that the total number of carbon atoms in $A_5$, $A_6$ and $A_7$ is 0 or 1; and Z represents a group of formula (B3):

$$-(AO)_n—Y \quad (B3)$$

wherein, A represents an alkylene groups having 2 to 3 carbon atoms, and preferably an alkylene groups having 2 carbon atoms, and a plurality of A may be the same or different; Y represents a hydrogen atom, a methyl group, a phenyl group or a benzyl group, preferably a hydrogen atom or a methyl group, and more preferably a hydrogen atom; and n is an average added mole number preferably of 10 to 100, and more preferably of 15 to 80.

The polymerization units composing the polymer compound of formula (B2) preferably satisfy such condition as that a percentage of the polymerization unit [—C(A6) ($A^6$)-C($A^7$) ($A^8$)-] is within the range from 40 to 99% by mass, more preferably 50 to 90% by mass, and even more preferably 60 to 85% by mass per unit mass of the polymer compound. From the viewpoint of stability, the percentage is preferably the lower limit or more, and from the viewpoint of detergency, the percentage is preferably the upper limit or less.

Component (B) is particularly preferably a polymer compound represented by formula (B2) wherein $A^1$ represents a hydrogen atom, $A^2$ represents a hydrogen atom, $A^3$ represents a hydrogen atom or a methyl group, $A^4$ represents —$COOX_2$, $A^5$ represents a hydrogen atom, $A^6$ represents a hydrogen atom, $A^7$ represents a hydrogen atom or a methyl group, $A^8$ represents —COO—Z or —$CH_2$—O—Z, and Z represents a group of formula (B3) wherein A represents an alkylene group having 2 carbon atoms, and Y represents a hydrogen atom or a methyl group. Specific examples of the compound include (meth)acrylic acid/polyethylene glycol (meth)acrylic acid ester copolymers, (meth)acrylic acid/methoxypolyethylene glycol (meth)acrylic acid ester copolymers, (meth) acrylic acid/polyethylene glycol allyl ether copolymers, (meth)acrylic acid/methoxypolyethylene glycol allyl ether copolymers, and salts thereof. As used herein, "(meth)acrylic acid" means acrylic acid and/or methacrylic acid.

Component (B) used in the present invention preferably has a weight average molecular weight of 2000 to 200000, and more preferably 5000 to 100000 as measured by gel permeation chromatography (GPC) with coupled two columns G4000PWXL+G2500PWXL (Tosoh Corporation), detecting with a differential reflective index detector, and eluting with 0.2M phosphate buffer/acetonitrile=9/1 (volume ratio), with a polyethylene glycol standard.

In the liquid detergent composition of the present invention, from the points of storage stability and detergency against mud, a content of component (B) is 0.3 to 8% by mass. The lower limit is preferably 1% by mass or more, and more preferably 1.5% by mass or more. The upper limit is preferably 5% by mass or less, and more preferably 4% by mass or less. When component (B) has the chain moiety (i) as the main chain and the chain moiety (ii) as a side chain, from the point of storage stability, the content is particularly preferably 2.5% by mass or less.

<(C) Water-Miscible Organic Solvent>

For stably blending component (B) and achieving good solubility, the liquid detergent composition of the present invention preferably contains (C) a water-miscible organic solvent [hereinafter, referred to as component (C)]. For stably blending component (B) and achieving good washing performance and solubility, component (C) is preferably a water-miscible organic solvent having a hydroxy group and/or an ether group. As used herein, the "water-miscible organic solvent" refers that dissolving in an amount of 50 g or more in 1 L of ion-exchanged water at 25° C., or that having a solubility of 50 g/L or more.

Examples of the water-miscible organic solvent include: (c1) alkanols such as ethanol, 1-propanol, 2-propanol, and 1-butanol; (c2) alkylene glycols having 2 to 6 carbon atoms and glycerols (hereinafter, also referred to as glycols) such as ethylene glycol, propylene glycol, butylene glycol, and hexylene glycol; (c3) polyalkylene glycols composed of an alkylene glycol unit having 2 to 4 carbon atoms such as diethylene glycol, triethylene glycol, tetraethylene glycol, dipropylene glycol, tripropylene glycol, and polyethylene glycol or polypropylene glycol having a weight average molecular weight of 400 to 4000; (c4) diethylene glycol monomethyl ether, diethylene glycol dimethyl ether, triethylene glycol monomethyl ether, diethylene glycol monoethyl ether, diethylene glycol diethyl ether, dipropylene glycol monomethyl ether, dipropylene glycol monoethyl ether, tripropylene glycol monomethyl ether, diethylene glycol monobutyl ether, and (poly)alkylene glycol (mono- or di-)alkyl ethers produced from (poly)alkylene glycols composed of an alkylene glycol unit having 2 to 4 carbon atoms such as 1-methoxy-2-propanol and 1-ethoxy-2-propanol and an alkanol having 1 to 5 carbon atoms (hereinafter, also referred to as alkyl ethers); (c5) alkyl glyceryl ethers having an alkyl group of 1 to 8 carbon atoms such as glyceryl-1,3-dimethyl ether, ethyl glyceryl ether, glyceryl-1,3-diethyl ether, glyceryl triethyl ether, iso- or n-pentyl glyceryl ether, octyl glyceryl ether, 2-ethylhexyl glyceryl ether, and diethylene glycol monobutyl ether; (c6) aromatic ethers of (poly)alkylene glycols composed of an alkylene glycol unit having 2 to 3 carbon atoms such as ethylene glycol monophenyl ether, diethylene glycol monophenyl ether, triethylene glycol monophenyl ether, polyethylene glycol monophenyl ether having an average molecular weight of about 480, ethylene glycol monobenzyl ether, and diethylene glycol monobenzyl ether.

Component (C) serves as a viscosity modifier or a gelation inhibitor of the composition. It preferably contains one kind or more of compound selected from the groups consisting of (c1) to (c6). Preferably used are (c1) alkanols, (c2) glycols, (c4) alkyl ethers, and (c6) aromatic ethers, and more specifically one kind or more of solvents selected from ethanol, propylene glycol, diethylene glycol monobutyl ether, 2-phenoxyethanol, diethylene glycol monophenyl ether, and triethylene glycol monophenyl ether, particularly two kinds or more solvents selected from the above group in combination is more preferred for effectively modifying viscosity of the composition and preventing gelation. In the present invention, particularly preferred examples are propylene glycol and/or diethylene glycol monobutyl ether.

Component (C) is particularly effective as a viscosity modifier or a gelation inhibitor of the composition. It preferably contains two or more compounds selected from the groups consisting of (c1) to (c6), more preferably selected from the group consisting of (c2), (c4), and (c6), and even more preferably selected from each group of (c2) and (c6). Such component (C) can effectively modify viscosity of the composition and preventing gelation.

For stably blending component (B) and achieving good solubility, a content of component (C) is preferably 5 to 40% by mass, and more preferably 10 to 35% by mass of the composition. When component (a1) is a compound in which R1 represents an alkyl group of a linear chain rate of 90% or more and particularly substantially 100%, the content is preferably 15 to 30% by mass.

For stably blending component (B) and achieving good solubility, the liquid detergent composition of the present invention contains water. A content of water is preferably 5% by mass or more, more preferably 8 to 40% by mass, and even more preferably 10 to 30% by mass of the composition. Water used is preferably that having no effect on the other components, including ion-exchanged water and the like.

For the liquid detergent composition of the present invention, the total amount of components (A) to (C) and water preferably accounts for 85% by mass or more, more preferably 90% by mass or more, and even more preferably 95% by mass or more.

<Other Components>

Hereinafter, other components that can be blended in the liquid detergent composition of the present invention will be described.

[Alkaline Agent (D)]

The liquid detergent composition of the present invention preferably further contains an alkaline agent (hereinafter, referred to as component (D)). Examples of the alkaline agent include alkaline metal hydroxides, alkaline metal carbonates, and alkanolamines containing 1 to 3 alkanol groups each having 2 to 4 carbon atoms commonly used in liquid detergents. In alkanolamines, an alkanol group is preferably a hydroxyethyl group. Other groups of alkanolamines are hydrogen atoms. An alkanolamine having a methyl group instead of a hydrogen atom may also be used as an alkaline agent. Examples of the alkanolamine include 2-aminoethanol, N-methylethanolamine, N,N-dimethylethanolamine, N,N-diethylethanolamine, diethanolamine, N-methyldiethanolamine, N-butyldiethanolamine, triethanolamine, triisopropanolamine, isopropanolamine mixture (containing mono-, di-, and triisopropanolamine), and the like. In the present invention, preferred are monoethanolamine and triethanolamine, and more preferred is monoethanolamine. Component (D) can serve as a pH adjuster as described below.

The liquid detergent composition of the present invention preferably contains component (D) in an amount of 0.5 to 8% by mass, and more preferably 1 to 7% by mass. An alkanolamine can be added as a counter ion of a salt of component (a2), and the like. An amount of such an alkanolamine is also included in the amount of component (D).

[Component (E)]

The liquid detergent composition of the present invention can further contain a chelating agent (hereinafter, referred to as component (E)). Component (E) can be any known chelating agent used in liquid detergents. Examples of the chelating agent include:

aminopolyacetic acids such as nitrilotriacetic acid, iminodiacetic acid, ethylenediaminetetraacetic acid, diethylenetriaminepentaacetic acid, glycol ether diaminetetraacetic acid, hydroxyethyliminodiacetic acid, triethylenetetraminehexaacetic acid, djenkolic acid, and the like, and the salts thereof;

organic acids such as diglycolic acid, oxydisuccinic acid, carboxymethyloxysuccinic acid, citric acid, lactic acid, tartaric acid, oxalic acid, malic acid, gluconic acid, carboxymethylsuccinic acid, carboxymethyltartaric acid, and the like, and the salts thereof; and others such as aminotri(methylenephosphonic acid), 1-hydroxyethylidene-1,1-diphosphonic acid, ethylenediaminetetra(methylenephosphonic acid), and diethylenetriaminepenta (methylenephosphonic acid), the alkaline metal salts and lower amine salts thereof, and the like. In the present invention, component (E) is preferably in a salt form with an alkanolamine as described in component (a2). Component (E) may be blended to the composition in an acid form and neutralized with the alkaline agent to form a salt in the composition.

A content of component (E) in the composition is, provided that component (E) is in an acid form, preferably 0.1 to 5% by mass, more preferably 0.1 to 4% by mass, and more preferably 0.1 to 3% by mass.

[Other Component]

The liquid detergent composition of the present invention can further contain the following components (I) to (XI) within the range that does not impair the effects of the present invention.

(I) an anti-redeposition agent and a dispersant (excluding the polymer compound as component (B)) such as polyacrylic acid, polymaleic acid, carboxymethylcellulose, polyethylene glycol having a weight average molecular weight of 5000 or more, maleic anhydride-diisobutylene copolymer, maleic anhydride-methyl vinyl ether copolymer, maleic anhydride-vinyl acetate copolymer, naphthalenesulfonate-formalin condensate, and polymers described in claims 1 to 21 of JP-A No. 59-62614 (p. 1, line 5 in column 3 to p. 3, line 14 in column 4)

(II) a dye transfer inhibitor such as polyvinylpyrrolidone (III) a bleach such as hydrogen peroxide, sodium percarbonate, and sodium perborate (IV) a bleach activator such as tetraacetylethylenediamine and those represented by formulae (I-2) to (I-7) in JP-A No. 06-316700

(V) an enzyme such as cellulase, amylase, pectinase, protease, and lipase (VI) an enzyme stabilizer such as a boron compound, a calcium ion source (calcium ion-donating compound), a bihydroxy compound, and formic acid (VII) a fluorescent dye such as commercially available Tinopal CBS (trade name, manufactured by Ciba Specialty Chemicals Inc.) and Whitex SA (trade name, manufactured by Sumitomo Chemical Co., Ltd.)

(VIII) an antioxidant such as butylhydroxytoluene, distyrenated cresol, sodium sulfite and sodium hydrogen sulfite (IX) a solubilizing agent such as p-toluenesulfonic acid, cumenesulfonic acid, m-xylenesulfonic acid, and a benzoate (also having effects as a preservative)

(X) a water-immiscible organic solvent including paraffins such as octane, decane, dodecane, and tridecane, olefins such as decene and dodecene, alkyl halides such as methylene chloride and 1,1,1-trichloroethane, terpenes such as D-limonene, and the like.

(XI) others including a dye, a fragrance, an antimicrobial preservative, and a defoaming agent such as silicone.

Hereinafter, described are indicative concentrations of these optional components in the liquid detergent composition of the present invention, when the composition contains them. These concentrations are appropriately adjusted within the range that does not impair the effects of the present invention. A component unsuited for the composition will be eliminated. The composition can contains the anti-redeposition agent and the dispersant (I) other than component (B) within the range that does not impair the effects of the present invention, but preferably substantially not contain when a surfactant concentration is higher and particularly when component (a1) is a compound having an ethylene oxide average addition mole number of 16 or more. A content of the dye transfer inhibitor (II) is preferably 0.01 to 10% by mass. A content of the bleach (III) is preferably 0.01 to 10% by mass. A content of the bleach activator (IV) is preferably 0.01 to 10% by mass. A content of the enzyme (V) is preferably 0.001 to 2% by mass. A content of the enzyme stabilizer (VI) is preferably 0.001 to 2% by mass. A content of the fluorescent dye (VII) is preferably 0.001 to 1% by mass. A content of the antioxidant (VIII) is preferably 0.01 to 2% by mass. A content of the solubilizing agent (IX) is preferably 0.1 to 2% by mass. A content of the water-immiscible organic solvent (X) is preferably 0.001 to 2% by mass. The others (XI) can be contained, for example, at a known concentration.

Among these optional components, (IX) and (X) have effects on stability of the liquid detergent composition, and thus must be added with caution in carefully selected amounts.

A pH value of the liquid detergent composition of the present invention is measured according to a method of JIS K3362:1998 at 20° C. For stably blending component (B) and achieving good washing performance, the pH is preferably 6 to 11, and more preferably 8 to 10 (25° C.).

From the point of ease of handling, the liquid detergent composition of the present invention preferably has a viscosity at 20° C. of 10 to 500 mPa·s, more preferably 50 to 400 mPa·s, and even more preferably 100 to 300 mPa·s. The viscosity is preferably adjusted to be within the range by using component (C) and the solubilizing agent.

In the present invention, a viscosity is measured with a B-type viscometer. A rotor is appropriately selected according to a viscosity. A viscosity of a liquid detergent composition is measured at a rotation number of 60 r/min 60 seconds after from the start of rotation.

From the viewpoint of usability, the liquid detergent composition of the present invention is preferably in a liquid form of an isotropic single phase. Weather the composition has an isotropic phase or not can be confirmed by observing visually with crossed Nicols or by X-ray diffraction to determine weather the composition has no structure or not. Confirmation of a single phase can be performed, for example, as that the composition is visually clear, there is no phase separation under microscopic observation, the composition does not occur phase separation to two or more phases by centrifugation, or the like.

The liquid detergent composition of the present invention can be filled in a container, for example, a plastic container including a measuring cap and a bottle to provide a bottled liquid detergent article. Examples of a material of which the bottle is made include plastics such as polypropylene (PP), poly(ethylene terephthalate) (PET), high density polyethylene (HDPE), medium density polyethylene (MDPE), and vinyl chloride (PVC). For preventing vacuum deformation of a molded plastic container due to reduced inner pressure of the container, the plastic container for filling the liquid detergent composition of the present invention preferably includes a receptacle part of the liquid detergent composition, that is made of a plastic having a flexural modulus (JIS K7171) of 2000 MPa or more and preferably 5000 MPa or less, and even more preferably 3000 MPa or less, and has a thickness of 0.3 to 1.5 mm. A plastic container including a bottle that satisfies these conditions of flexural modulus and thickness is generally used. The reason of deformation of the container may be that the liquid detergent composition of the present invention contains a nonionic surfactant at high concentration, and dissolves oxygen present inside the bottle therein. Since transmitted light increases solubility of oxygen, the receptacle part for the liquid detergent composition preferably has a light transmittance of 15% or less in the wavelength range of 600 nm to 700 nm. The bottle generally has such a light transmittance. To increase lightproof properties, titanium oxide and carbon black can be added to a plastic constructing the container.

The liquid detergent composition of the present invention is also filled in a refill container to provide a refill article. In this case, from the viewpoint of storage stability, the refill container is a pouch formed by adhering flexible laminated resin films.

From the viewpoint of ease of use, the pouch is preferably further provided with a nozzle part having a pouring path at a corner of the upper part, that nozzle part being subjected to a laser-processing, score-processing, or the like and having a form that will produce a pouring outlet when torn with hands at the corner of the upper part. For the shape of the pouch, a standing pouch is one of preferred types for easy handling.

Although the film for forming the pouch may be a flexible single layer resin film, generally used is a laminated resin film. Examples of abase layer material of the laminated resin film include oriented nylon (ONy), polyethylene terephthalate) (PET), and oriented polypropylene (OPP). Examples of a sealant layer material include cast polypropylene (CPP), linear low density polyethylene (LLDPE), high density polyethylene (HDPE), and low density polyethylene (LDPE). Examples of a barrier layer material include aluminum evaporated poly(ethylene terephthalate) (VM-PET), ceramic-deposited poly(ethylene terephthalate), aluminum foil, and the like.

Particularly for preventing occurrence of delamination during long-period storage, the laminated resin film preferably has a structure composed of three or more layers and inserted with no printing ink (an ink layer) between a middle layer and the innermost layer. Considering effect of preventing delamination, productive adequacy, dropping strength, ease of opening, and package cost, the laminate film is particularly preferably composed of PET (preferably having a thickness of 9 to 25 μm)/[an ink layer+an adhesive layer]/ONy (preferably having a thickness of 15 to 25 μm)/an adhesive layer/LLDPE (preferably having a thickness of 60 to 200 μm) in this order from the outer layer (the furthest layer from the layer contacting with the liquid detergent composition).

The liquid detergent composition of the present invention is suitable for fiber products such as clothing materials, bedclothes, and fabrics.

EXAMPLES

The following Examples demonstrate the present invention. Examples are intended to illustrate the present invention and not to limit the present invention.

Synthesis Example 1

Preparation of Synthetic Polymer (1)

Polyethylene glycol (ethylene oxide average addition mole number: 23) monomethacrylate/methacrylic acid=75/25 (mass ratio) copolymer [synthetic polymer (1)] was prepared as follows.

In a glass reactor equipped with a thermometer, a stirrer, a nitrogen inlet, and a reflux condenser, 142 g of propylene glycol (manufactured by Wako Pure Chemical Industries, Ltd.) and 400 g of ion-exchanged water were mixed and heated to 80° C. under nitrogen atmosphere. To this were separately added a solution, prepared by dissolving 750 g of polyethylene glycol (ethylene oxide average mole number: 23) monomethacrylate (NK-ester M-230T, manufactured by Shin-Nakamura Chemical Co., Ltd.), 250 g of methacrylic acid (manufactured by Wako Pure Chemical Industries, Ltd.), and 8 g of 2-mercaptoethanol (manufactured by Wako Pure Chemical Industries, Ltd.) in 590 g of propylene glycol and 30 g of ion-exchanged water, and a solution of 8 g of sodium persulfate (manufactured by Wako Pure Chemical Industries, Ltd.) and 4 g of 30% hydrogen peroxide solution (manufactured by Sigma-Aldrich) in 146 g of ion-exchanged water, dropwise for two hours and, after the dropwise addition, the mixture further stirred for one hour at 80° C. Then to this was added a solution of 8 g of sodium persulfate and 4 g of 30% hydrogen peroxide solution in 74 g of ion-exchanged water for five minutes and further stirred for one hour at 80° C. Then to this was added a solution of 8 g of sodium persulfate and 4 g of 30% hydrogen peroxide solution in 74 g of ion-exchanged water for five minutes and further stirred for one hour at 80° C. The reaction mixture was returned to a room temperature. 2500 g of synthetic polymer solution (polymer concentration: 40% by mass) was obtained. GPC measurement showed that the resulting synthetic polymer (1) had a weight average molecular weight of 50000 (based on polyethylene glycol standard). The synthetic polymer (1) had the chain moiety (i) as a side chain and the chain moiety (ii) as the main chain. A percentage of polymerization units derived from an epoxide having 2 to 5 carbon atoms in the chain moiety (i) was 63% by mass per unit mass of the polymer compound. A percentage of monomers[ ]derived from one or more unsaturated carboxylic acid monomers selected from acrylic acid, methacrylic acid and maleic acid in the chain moiety (ii) was 26% by mass per unit mass of the polymer compound.

Synthesis Example 2

Preparation of Synthetic Polymer (2)

Polyethylene glycol (ethylene oxide average addition mole number: 23) monomethacrylate/methacrylic acid=65/35 (mass ratio) copolymer [synthetic polymer (2)] was prepared as follows.

In a glass reactor equipped with a thermometer, a stirrer, a nitrogen inlet, and a reflux condenser, 127 g of propylene glycol (manufactured by Wako Pure Chemical Industries, Ltd.) and 299 g of ion-exchanged water were mixed under nitrogen atmosphere and heated to 80° C. To this were separately added a solution, prepared by dissolving 650 g of polyethylene glycol (ethylene oxide average mole number: 23) monomethacrylate (NK-ester M-230T, manufactured by Shin-Nakamura Chemical Co., Ltd.), 350 g of methacrylic acid (manufactured by Wako Pure Chemical Industries, Ltd.), and 11 g of 2-mercaptoethanol (manufactured by Wako Pure Chemical Industries, Ltd.) in 600 g of propylene glycol, and 37 g of ion-exchanged water, and a solution of 11 g of sodium persulfate (manufactured by Wako Pure Chemical Industries, Ltd.) and 4 g of 30% hydrogen peroxide solution (manufactured by Sigma-Aldrich) in 191 g of ion-exchanged water, dropwise for two hours and further stirred for one hour at 80° C. Then to this was added a solution of 11 g of sodium persulfate and 4 g of 30% hydrogen peroxide solution in 95 g of ion-exchanged water for five minutes and further stirred for one hour at 80° C. Then to this was added a solution of 11 g of sodium persulfate and 4 g of 30% hydrogen peroxide solution in 95 g of ion-exchanged water for five minutes and further stirred for one hour at 80° C. The reaction mixture was returned to a room temperature. 2500 g of synthetic polymer solution (polymer concentration: 40% by mass) was obtained. GPC measurement showed that the resulting synthetic polymer (2) had a weight average molecular weight of 46000 (based on polyethylene glycol standard). The synthetic polymer (2) had the chain moiety (i) as a side chain and the chain moiety (ii) as the main chain. A percentage of polymerization units derived from an epoxide having 2 to 5 carbon atoms in the chain moiety (i) was 59% by mass per unit mass of the polymer compound. A percentage of monomers derived from one kind or more of unsaturated carboxylic acid monomer selected from acrylic acid, methacrylic acid and maleic acid in the chain moiety (ii) was 35% by mass per unit mass of the polymer compound.

Synthesis Example 3

Preparation of Synthetic Polymer (3)

Polyethylene glycol (ethylene oxide average addition mole number: 25) allyl ether/acrylic acid=75/25 (mass ratio) copolymer [synthetic polymer (3)] was prepared as follows.

In a glass reactor equipped with a thermometer, a stirrer, a nitrogen inlet, and a reflux condenser, 587 g of propylene glycol (manufactured by Wako Pure Chemical Industries, Ltd.), 367 g of ion-exchanged water, 300 g of polyethylene glycol (ethylene oxide average addition mole number: 25) allyl ether, and 6.3 g of aqueous solution of 80% acrylic acid (manufactured by Toagosei Co., Ltd) were mixed under nitrogen atmosphere and heated to 85° C. To this were separately added a mixed solution of 300 g of polyethylene glycol (ethylene oxide average addition mole number: 25) allyl ether, 125 g of aqueous solution of 80% acrylic acid, and 75 g of ion-exchanged water, and a mixed solution of 10.3 g of sodium persulfate (manufactured by Wako Pure Chemical Industries, Ltd.), 41.3 g of ion-exchanged water, and 10.2 g of 30% hydrogen peroxide solution (manufactured by Sigma-Aldrich), dropwise for 150 minutes. After the dropwise addition, then, to this were separately added 119 g of aqueous solution of 80% acrylic acid and a mixed solution of 9.8 g of sodium persulfate, 39.3 g of ion-exchanged water, and 9.6 g of 30% hydrogen peroxide solution, dropwise for 285 minutes. After the dropwise addition, the mixture was further stirred for three hours at 85° C. The reaction mixture was returned to a room temperature. 2000 g of synthetic polymer solution (polymer concentration: 40% by mass) was obtained. GPC measurement showed that the resulting synthetic polymer (3) had a weight average molecular weight of 22000 (based on polyethylene glycol standard). The synthetic polymer (3) had the chain moiety (i) as a side chain and the chain moiety (ii) as the main chain. A percentage of polymerization units derived from an epoxide having 2 to 5 carbon atoms in the chain moiety (i) was 71% by mass per unit mass of the polymer compound. A percentage of monomers derived from one or more unsaturated carboxylic acid monomers selected from acrylic acid, methacrylic acid and maleic acid in the chain moiety (ii) was 25% by mass per unit mass of the polymer compound.

Reference Examples 1, 17, and 18, Examples 2 to 16 and 19 to 22, and Comparative Examples 1 to 6

Respective components shown in Tables 1 to 4 were mixed. Compositions of Reference Examples, Examples, and Comparative Examples were obtained. The resultant compositions were subjected to the following evaluations. Results are shown in Tables 1 to 4. Compositions of Examples were in a liquid form of an isotropic single phase.

(1) Test for Anti-Redeposition of Mud

A white cotton cloth (canequim 2003 cloth) was cut into pieces of 10 cm by 10 cm. Five of these pieces made a set. One little of aqueous solution of a detergent for evaluation and Kanuma Akatsutsi (reddish soil) were mixed and tested with a Terg-O-Tometer under the following conditions.

| <Test conditions> | |
|---|---|
| Washing time | 10 minutes |
| Detergent concentration | 0.033% by mass |
| Water hardness | 4° DH |
| Water temperature | 20° C. |
| Rinsing | rinsing with flowing tap water for 5 minutes at 20° C. |

For evaluating anti-redeposition ability, an original cloth (white cloth) before washing and a stained cloth after tested were measured for reflectance with a self-recording colorimeter (manufactured by Shimadzu Corporation) at 460 nm. An anti-redeposition rate was calculated according to the following equation.

anti-redeposition rate (%)=(reflectance after tested/reflectance of an original cloth)×100

(2) Evaluation of Storage Stability

In a 50 mL sample vial (No. 6 standard wide-mouth bottle, made of glass, a cylindrical shape having a diameter of 40 mm and a height of 80 mm), 40 mL of liquid detergent composition was filled, sealed with a cap, and allowed to stand for 20 days at 50° C. or 20° C. The liquid detergent composition was observed visually and judged for stability according to the following rating:

○: A composition has a uniform liquid phase without formation of liquid crystal and/or crystal, and is good in liquid stability.

x: Formation of liquid crystal or crystal, separation, or precipitation is observed.

(3) Evaluation of Solubility 19 samples of different concentrations in an increment of 5% by mass were prepared by mixing a liquid detergent composition with ion-exchanged water such that [(mass of liquid detergent composition)/(mass of liquid detergent composition+mass of ion-exchanged water)]×100=5 to 95% by mass. Samples were allowed to stand for one day at 20° C. in a thermostatic chamber. These samples were then measured for viscosity at 20° C. under the following conditions and judged according to the following rating. This experiment is a model test for solubility in water at 20° C.

Instrument: digital B-type viscometer (model; DV M-B) manufactured by Tokyo Keiki Inc.

Condition: 60 r/min, for 60 seconds

○: All samples have a viscosity lower than 1500 mPa·s. This means that a composition does not thicken in dilution in water due to formation of liquid crystal and/or crystal. The composition is considered as having good solubility.

x: One or more samples have a viscosity 1500 mPa·s or more. This means that, in some cases, a composition thickens in dilution in water due to formation of liquid crystal and/or crystal. The composition is considered as having an insufficient solubility.

TABLE 1

| | | | | | Reference example | Example | | | | | | |
|---|---|---|---|---|---|---|---|---|---|---|---|---|
| | | | | | 1 | 2 | 3 | 4 | 5 | 6 | 7 | 8 |
| Liquid detergent composition | Compounding component (mass %) | (A) | (a1) | (a1-1) | 46 | | | | | | | |
| | | | | (a1-2) | | 46 | | | | | | |
| | | | | (a1-3) | | | 46 | | | | | |
| | | | | (a1-4) | | | | 46 | | | | |
| | | | | (a1-5) | | | | | 46 | | | |
| | | | | (a1-6) | | | | | | 46 | | |
| | | | | (a1-7) | | | | | | | 46 | |
| | | | | (a1-8) | | | | | | | | 46 |
| | | | | (a1-9) | | | | | | | | |
| | | | (a2) | (a2-1) | 17.5 | 17.5 | 17.5 | 17.5 | 17.5 | 17.5 | 17.5 | 17.5 |
| | | | | (a2-2) | | | | | | | | |
| | | | | (a2-3) | 2.5 | 2.5 | 2.5 | 2.5 | 2.5 | 2.5 | 2.5 | 2.5 |
| | | | (a3) | (a3-1) | | | | | | | | |
| | | | | (a3-2) | | | | | | | | |
| | | | | (a3-3) | | | | | | | | |
| | | | | (a3-4) | | | | | | | | |
| | | (B) | | (b-1) | | | | | | | | |
| | | | | (b-2) | | | | | | | | |
| | | | | (b-3) | 3 | 3 | 3 | 3 | 3 | 3 | 3 | 3 |
| | | | | (b-4) | | | | | | | | |
| | | (C) | | (c-1) | 12 | 12 | 12 | 12 | 12 | 12 | 12 | 12 |
| | | | | (c-2) | 2 | 2 | 2 | 2 | 2 | 2 | 2 | 2 |
| | | | | (c-3) | | | | | | | | |
| | | | | (c-4) | | | | | | | | |
| | | (D) | | Monoethanolamine | 5 | 5 | 5 | 5 | 5 | 5 | 5 | 5 |
| | | Other component | | Polymer(1) | | | | | | | | |
| | | | | Sodium sulfite | | | | | | | | |
| | | | | Fluorescent dye | | | | | | | | |
| | | | | Enzyme | | | | | | | | |

TABLE 1-continued

| | | | Reference example | Example | | | | | | |
|---|---|---|---|---|---|---|---|---|---|---|
| | | | 1 | 2 | 3 | 4 | 5 | 6 | 7 | 8 |
| | | Dye (1) | 0.0005 | 0.0005 | 0.0005 | 0.0005 | 0.0005 | 0.0005 | 0.0005 | 0.0005 |
| | | fragrance | 1 | 1 | 1 | 1 | 1 | 1 | 1 | 1 |
| | Ion-exchanged water | | 11.0 | 11.0 | 11.0 | 11.0 | 11.0 | 11.0 | 11.0 | 11.0 |
| | Total | | 100 | 100 | 100 | 100 | 100 | 100 | 100 | 100 |
| | Content of component (A) (mass %) | | 66 | 66 | 66 | 66 | 66 | 66 | 66 | 66 |
| | Content of component (a1) (mass %) | | 46 | 46 | 46 | 46 | 46 | 46 | 46 | 46 |
| | (a1) + (a2) (mass %) | | 66 | 66 | 66 | 66 | 66 | 66 | 66 | 66 |
| | (a1)/(a2) (mass ratio) | | 70/30 | 70/30 | 70/30 | 70/30 | 70/30 | 70/30 | 70/30 | 70/30 |
| | [(a1) + (a3)]/(a2) (mass ratio) | | 70/30 | 70/30 | 70/30 | 70/30 | 70/30 | 70/30 | 70/30 | 70/30 |
| (1) anti-redeposition of mud (%) | | | 91 | 91 | 90 | 91 | 90 | 90 | 91 | 90 |
| (2) Storage stability | | 50° C. | ○ | ○ | ○ | ○ | ○ | ○ | ○ | ○ |
| | | 20° C. | ○ | ○ | ○ | ○ | ○ | ○ | ○ | ○ |
| (3) Solubility | | | ○ | ○ | ○ | ○ | ○ | ○ | ○ | ○ |

TABLE 2

| | | | | | Example | | | | | | | |
|---|---|---|---|---|---|---|---|---|---|---|---|---|
| | | | | | 9 | 10 | 11 | 12 | 13 | 14 | 15 | 16 |
| Liquid detergent composition | Compounding component (mass %) | (A) | (a1) | (a1-1) | | | | | | | | |
| | | | | (a1-2) | | | | | | | | |
| | | | | (a1-3) | 35 | 55 | 60 | 70 | 47 | 46 | 46 | 46 |
| | | | | (a1-4) | | | | | | | | |
| | | | | (a1-5) | | | | | | | | |
| | | | | (a1-6) | | | | | | | | |
| | | | | (a1-7) | | | | | | | | |
| | | | | (a1-8) | | | | | | | | |
| | | | | (a1-9) | | | | | | | | |
| | | | (a2) | (a2-1) | 25 | 5.5 | 3.5 | | 15 | 17.5 | 17.5 | 17.5 |
| | | | | (a2-2) | | | | | 1 | | | |
| | | | | (a2-3) | 2.5 | 2.5 | 2.5 | | 1.5 | 2.5 | 2.5 | 2.5 |
| | | | (a3) | (a3-1) | | | | | 3 | | | |
| | | | | (a3-2) | | | | | | | | |
| | | | | (a3-3) | | | | | | | | |
| | | | | (a3-4) | | | | | | | | |
| | | (B) | | (b-1) | | | | | | | 3 | |
| | | | | (b-2) | | | | | | 3 | | |
| | | | | (b-3) | 3 | 3 | 3 | 3 | 3 | | | |
| | | | | (b-4) | | | | | | | | 1.5 |
| | | (C) | | (c-1) | 12 | 12 | 12 | 12 | 5 | 12 | 12 | 12 |
| | | | | (c-2) | 2 | 2 | 2 | 2 | | 2 | 2 | 2 |
| | | | | (c-3) | | | | | 2 | | | |
| | | | | (c-4) | | | | | 5 | | | |
| | | (D) | | Monoethanolamine | 6.4 | 2.7 | 2.4 | 1.7 | 5 | 5 | 5 | 5 |
| | | Other component | | Polymer(1) | | | | | | | | |
| | | | | Sodium sulfite | | | | | 0.1 | | | |
| | | | | Fluorescent dye | | | | | 0.2 | | | |
| | | | | Enzyme | | | | | 1 | | | |
| | | | | Dye (1) | 0.0005 | 0.0005 | 0.0005 | 0.0005 | 0.0005 | 0.0005 | 0.0005 | 0.0005 |
| | | | | fragrance | 1 | 1 | 1 | 1 | 1 | 1 | 1 | 1 |
| | | Ion-exchanged water | | | 13.1 | 16.3 | 13.6 | 10.3 | 10.2 | 11.0 | 11.0 | 12.5 |
| | | Total | | | 100 | 100 | 100 | 100 | 100 | 100 | 100 | 100 |
| | | Content of component(A) (mass %) | | | 62.5 | 63 | 66 | 70 | 67.5 | 66 | 66 | 66 |
| | | Content of component (a1) (mass %) | | | 35 | 55 | 60 | 70 | 47 | 46 | 46 | 46 |
| | | (a1) + (a2) (mass %) | | | 62.5 | 63 | 66 | 70 | 64.5 | 66 | 66 | 66 |
| | | (a1)/(a2) (mass ratio) | | | 56/44 | 87/13 | 91/9 | 100/0 | 73/27 | 70/30 | 70/30 | 70/30 |
| | | [(a1) + (a3)]/(a2) (mass ratio) | | | 56/44 | 87/13 | 91/9 | 100/0 | 74/26 | 70/30 | 70/30 | 70/30 |
| (1) anti-redeposition of mud (%) | | | | | 92 | 91 | 90 | 89 | 91 | 92 | 90 | 88 |
| (2) Storage stability | | | | 50° C. | ○ | ○ | ○ | ○ | ○ | ○ | ○ | ○ |
| | | | | 20° C. | ○ | ○ | ○ | ○ | ○ | ○ | ○ | ○ |
| (3) Solubility | | | | | ○ | ○ | ○ | ○ | ○ | ○ | ○ | ○ |

TABLE 3

| | | | | | Reference example | | Example | | | |
|---|---|---|---|---|---|---|---|---|---|---|
| | | | | | 17 | 18 | 19 | 20 | 21 | 22 |
| Liquid detergent composition | Compounding component (mass %) | (A) | (a1) | (a1-1) | 35 | 55 | | | | |
| | | | | (a1-2) | | | | | | |
| | | | | (a1-3) | | | | 30 | 30 | |
| | | | | (a1-4) | | | | | | |
| | | | | (a1-5) | | | | | | |
| | | | | (a1-6) | | | 55 | | | |
| | | | | (a1-7) | | | | | | |
| | | | | (a1-8) | | | | | | |
| | | | | (a1-9) | | | | | | 46 |
| | | | (a2) | (a2-1) | 25 | 5.5 | 5.5 | 27.5 | 10 | 17.5 |
| | | | | (a2-2) | | | | | | |
| | | | | (a2-3) | 2.5 | 2.5 | 2.5 | 2.5 | 2.5 | 2.5 |
| | | | (a3) | (a3-1) | | | | | | |
| | | | | (a3-2) | | | | | | |
| | | | | (a3-3) | | | | | | |
| | | | | (a3-4) | | | | | | |
| | | (B) | | (b-1) | | | | | | |
| | | | | (b-2) | | | | | | |
| | | | | (b-3) | 3 | 3 | 3 | 3 | 3 | 3 |
| | | | | (b-4) | | | | | | |
| | | (C) | | (c-1) | 12 | 12 | 12 | 12 | 12 | 12 |
| | | | | (c-2) | 2 | 2 | 2 | 2 | 2 | 2 |
| | | | | (c-3) | | | | | | |
| | | | | (c-4) | | | | | | |
| | | (D) | | Monoethanol amine | 6.4 | 2.7 | 2.7 | 6.9 | 3.6 | 5 |
| | | Other component | | Polymer(1) | | | | | | |
| | | | | Sodium sulfite | | | | | | |
| | | | | Fluorescent dye | | | | | | |
| | | | | Enzyme | | | | | | |
| | | | | Dye (1) | 0.0005 | 0.0005 | 0.0005 | 0.0005 | 0.0005 | 0.0005 |
| | | | | fragrance | 1 | 1 | 1 | 1 | 1 | 1 |
| | | Ion-exchanged water | | | 13.1 | 16.3 | 16.3 | 15.1 | 35.9 | 11.0 |
| | | Total | | | 100 | 100 | 100 | 100 | 100 | 100 |
| | Content of component (A) (mass %) | | | | 62.5 | 63 | 63 | 63 | 42.5 | 66 |
| | Content of component (a1) (mass %) | | | | 35 | 55 | 55 | 30 | 30 | 46 |
| | (a1) + (a2) (mass %) | | | | 62.5 | 63 | 63 | 63 | 42.5 | 66 |
| | (a1)/(a2) (mass ratio) | | | | 56/44 | 87/13 | 87/13 | 48/52 | 71/29 | 70/30 |
| | [(a1) + (a3)]/(a2) (mass ratio) | | | | 56/44 | 87/13 | 87/13 | 50/50 | 71/29 | 70/30 |
| (1) anti-redeposition of mud (%) | | | | | 92 | 91 | 91 | 92 | 90 | 91 |
| (2) Storage stability | | | | 50° C. | ○ | ○ | ○ | ○ | ○ | ○ |
| | | | | 20° C. | ○ | ○ | ○ | ○ | ○ | ○ |
| (3) Solubility | | | | | ○ | ○ | ○ | ○ | ○ | ○ |

TABLE 4

| | | | | | Comparative example | | | | | |
|---|---|---|---|---|---|---|---|---|---|---|
| | | | | | 1 | 2 | 3 | 4 | 5 | 6 |
| Liquid detergent composition | Compounding component (mass %) | (A) | (a1) | (a1-1) | | | | | | |
| | | | | (a1-2) | | | | | | |
| | | | | (a1-3) | 46 | 46 | | | 20 | |
| | | | | (a1-4) | | | | | | |
| | | | | (a1-5) | | | | | | |
| | | | | (a1-6) | | | | | | |
| | | | | (a1-7) | | | | | | |
| | | | | (a1-8) | | | | | | |
| | | | | (a1-9) | | | | | | |
| | | | (a2) | (a2-1) | 17.5 | 17.5 | 17.5 | 17.5 | 17.5 | 17.5 |
| | | | | (a2-2) | | | | | | |
| | | | | (a2-3) | 2.5 | 2.5 | 2.5 | 2.5 | 2.5 | 2.5 |
| | | | (a3) | (a3-1) | | | | | | |
| | | | | (a3-2) | | | 46 | | | |
| | | | | (a3-3) | | | | 46 | | |
| | | | | (a3-4) | | | | | | 46 |
| | | (B) | | (b-1) | | | | | | |
| | | | | (b-2) | | | | | | |
| | | | | (b-3) | | | 3 | 3 | 3 | 3 |
| | | | | (b-4) | | | | | | |
| | | (C) | | (c-1) | 12 | 12 | 12 | 12 | 12 | 12 |
| | | | | (c-2) | 2 | 2 | 2 | 2 | 2 | 2 |
| | | | | (c-3) | | | | | | |

TABLE 4-continued

| | | Comparative example | | | | | |
|---|---|---|---|---|---|---|---|
| | | 1 | 2 | 3 | 4 | 5 | 6 |
| | (c-4) | | | | | | |
| (D) | Monoethanol amine | 5 | 5 | 5 | 5 | 5 | 5 |
| Other component | Polymer(1) | | 3 | | | | |
| | Sodium sulfite | | | | | | |
| | Fluorescent dye | | | | | | |
| | Enzyme | | | | | | |
| | Dye(1) | 0.0005 | 0.0005 | 0.0005 | 0.0005 | 0.0005 | 0.0005 |
| | fragrance | 1 | 1 | 1 | 1 | 1 | 1 |
| Ion-exchanged water | | 14.0 | 11.0 | 11.0 | 11.0 | 37.0 | 11.0 |
| Total | | 100 | 100 | 100 | 100 | 100 | 100 |
| Content of component(A) (mass %) | | 66 | 66 | 66 | 66 | 40 | 20 |
| Content of component (a1) (mass %) | | 46 | 46 | 0 | 0 | 20 | 46 |
| (a1) + (a2) (mass %) | | 66 | 66 | 20 | 20 | 40 | 66 |
| (a1)/(a2) (mass ratio) | | 70/30 | 70/30 | 0/100 | 0/100 | 50/50 | 70/30 |
| [(a1) + (a3)]/(a2) (mass ratio) | | 70/30 | 70/30 | 70/30 | 70/30 | 50/50 | 70/30 |
| (1) anti-redeposition of mud (%) | | 70 | 92 | 90 | 90 | 90 | 91 |
| (2) Storage stability | 50° C. | ○ | X | ○ | ○ | X | ○ |
| | 20° C. | ○ | X | ○ | X | X | ○ |
| (3) Solubility | | ○ | ○ | X | X | ○ | X |

cf. Components in tables are as follows. In Tables, an amount of monoethanolamine of component (E) was shown as it contained an alkanolamine derived from (a2-2).

Component (a1)

(reference a1-1): an adduct of ethylene oxide in an average amount of 20 mol to a primary, linear alcohol having 10 to 14 carbon atoms.

(a1-2): a block adduct of ethylene oxide and propylene oxide in this order in average amounts of 18 mol and 2 mol, respectively, to a primary, linear alcohol having 10 to 14 carbon atoms, in which compounds having a structure $R^1$—O-EO— accounted for 90% by mol or more.

(a1-3): a block adduct of ethylene oxide, propylene oxide, and ethylene oxide in this order in average amounts of 9 mol, 2 mol, and 9 mol, respectively, to a primary mol to a primary linear alcohol having 10 to 14 carbon atoms, in which compounds having a structure $R^1$—O-EO— accounted for 85% by mol or more, and compounds having a structure -EO-H accounted for 90% by mol or more.

(a1-4): a random adduct of ethylene oxide and propylene oxide in average amounts of 18 mol and 2 mol, respectively, to a primary mol to a primary linear alcohol having 10 to 14 carbon atoms, in which compounds having a structure $R^1$—O-EO— accounted for 85% by mol or more, and compounds having a structure -EO-H accounted for 90% by mol or more.

(a1-5): a block adduct of ethylene oxide and propylene oxide in this order in average amounts of 18 mol and 2 mol, respectively, to Dobanol 23 (trade name) (manufactured by Mitsubishi Chemical Corporation, having an alkyl of 13 carbon atoms methyl-blanched at β-position, a content of blanched alkyl: 20% by mass), in which compounds having a structure $R^1$—O-EO— accounted for 90% by mol or more.

(a1-6): an adduct of ethylene oxide in an average amount of 20 mol to a secondary alcohol having 12 to 14 carbon atoms.

(a1-7): a block adduct of ethylene oxide, propylene oxide, and ethylene oxide in this order in average amounts of 7 mol, 2 mol, and 7 mol, respectively, to a primary mol to a primary linear alcohol having 10 to 14 carbon atoms, in which compounds having a structure $R^1$—O-EO— accounted for 80% by mol or more, and compounds having a structure -EO-H accounted for 85% by mol or more.

(a1-8): a block adduct of ethylene oxide, propylene oxide, and ethylene oxide in this order in average amounts of 15 mol, 2 mol, and 15 mol, respectively, to a primary mol to a primary linear alcohol having 10 to 14 carbon atoms, in which compounds having a structure $R^1$—O-EO— accounted for 90% by mol or more, and compounds having a structure -EO-H accounted for 95% by mol or more.

(a1-9): a block adduct of ethylene oxide and propylene oxide in this order in average amounts of 16 mol and 2 mol, respectively, to a primary mol to a primary linear alcohol having 10 to 14 carbon atoms, in which compounds having a structure $R^1$—O-EO— accounted for 90% by mol or more.

Component (a2)

(a2-1): an alkylbenzenesulfonic acid containing a linear alkyl group having 10 to 14 carbon atoms (a2-2): a polyoxyethylene alkyl ether sulfuric acid salt (linear alkyl having 10 to 14 carbon atoms, ethylene oxide average addition mole number: 3, monoethanolamine salt, concentrations shown in Tables 1 to 4 were calculated as it was in an acid form)

(a2-3): Lunac L-55 (trade name) (palm oil-based fatty acid; manufactured by Kao Corporation)

Component (a3)

(a3-1): an adduct of ethylene oxide in an average amount of 3 mol to a secondary alcohol having 12 to 14 carbon atoms [Softanol 30 (trade name), manufactured by Nippon Shokubai Co., Ltd.]

(a3-2): an adduct of ethylene oxide in an average amount of 12 mol to a primary mol to a primary linear alcohol having 10 to 14 carbon atoms (a3-3): an adduct of ethylene oxide in an average amount of 40 mol to a primary mol to a primary linear alcohol having 10 to 14 carbon atoms (a3-4): a block adduct of ethylene oxide and propylene oxide in this order in average amounts of 10 mol and 2 mol, respectively, to a primary mol to a primary linear alcohol having 10 to 14 carbon atoms, in which compounds having a structure $R^1$—O-EO— accounted for 90% by mol or more.

Component (B)

(b-1): synthetic polymer (1) described in Synthesis Example 1

(b-2): synthetic polymer (2) described in Synthesis Example 2

(b-3): synthetic polymer (3) described in Synthesis Example 3

(b-4): a polymer compound prepared according to a method described in JP-A No. 10-60476, paragraph 0020, Synthesis Example 1 [polymer compound having the chain moiety (i) as the main chain and the chain moiety (ii) as a side chain]

Component (C)

(c-1): diethylene glycol monobutyl ether (c-2): propylene glycol (c-3): triethylene glycol monophenyl ether (c-4): ethanol Polymer (1): polyacrylic acid (weight average molecular weight: 10000)

Fluorescent dye: Tinopal CBS-X (trade name) (manufactured by Ciba Specialty Chemicals Inc.)

Enzyme: Everlase 16.0L-EX (trade name) (protease, manufactured by Novozymes)

Dye (1): Green No. 202

For Examples 2 to 16 and 19 to 21, storage stabilities were also rated as "○" according to the evaluation (2) after 20 days' storage at 10° C., and further, viscosities measured at 10° C. were also rated as "○" according to the evaluation of solubility (3) after one day's storage at 10° C. in a thermostatic chamber. Moreover, for Examples 3, 9, 10, 13 to 16 and 19 to 21, storage stabilities were also rated as "○" according to the evaluation (2) after 20 days' storage at 5° C., and further, viscosities measured at 5° C. were also rated as "○" according to the evaluation of solubility (3) after one day's storage at 5° C. in a thermostatic chamber.

Liquid detergent compositions were also tested for detergency to a dirty collar mainly stained with skin oil according to the following method. Results showed that Examples 1 to 5, 7 to 10, 13 to 18, and 20 to 21 had a significant superiority to a standard detergent.

*Evaluation of Detergency

Clothes with a dirty collar are prepared according to JIS K3362:1998. According to a method for evaluating detergency of a synthetic laundry detergent described in JIS K 3362:1998, liquid detergent compositions in Tables 1 to 4 were measured for detergency and compared with that of a standard detergent for judging detergency.

For further evaluation of storage stability, liquid detergent compositions were filled in pouches and evaluated as a refill product. As a film for the pouch, a laminate film consisting of PET 12 μm/[ink layer+adhesive layer]/ONy 15 μm/adhesive layer/LLDPE 150 μm in this order from the outer layer (the furthest layer from the layer contacting with a liquid detergent composition) was used to form a self-standing pouch having dimensions of 120 mm width and 215 mm height and a folding-in width at the bottom of 34.5 mm. Among liquid detergent compositions, Examples 1 to 21 that provided good results at the previous evaluation were each filled in an amount of 320 g in the self-standing pouch. The filled pouches were heat-sealed at the top thereof. After 20 days storage at 20° C., these refill liquid detergents packed in the plastic pouch exhibited not abnormality such as separation but good stability. These refill liquid detergents were also subjected to an accelerated test for evaluating delamination for 14 days at 65° C. In all of these refill liquid detergents, delamination of the film did not occur.

Storage stability was also evaluated in cases of using a container including a bottle, a body cap attached to a mouth of the bottle, and a measuring cap attached to the body cap in a detachable way. In a cylindrical bottle of a full volume of 438 mL, the largest outside diameter of 61 mm, an outer diameter of the body of 59 mm, a height of 190 mm, and an average thickness of the bottle body of 0.5 mm made of PET resin (flexural modulus (JIS K7171): 2400 MPa, light transmittance in the range 600 to 700 nm: 10% or less) containing 1.0% by mass of titanium oxide, liquid detergent compositions of Examples 1 to 21 were each filled in an amount 400 g. The body cap, previously attached with the measuring cap (measuring volume: 26 mL), was fitted around the bottle to seal. These bottled liquid detergents in the plastic container which stored at 20° C. for 20 days, exhibited not abnormality such as separation and vacuum deformation of the bottle wall but good stability. These bottled liquid detergents were also subjected to an accelerated test for evaluating vacuum deformation under conditions of 14 days at 40° C. or sunlight exposure for about one month. In all of these bottled liquid detergents under any condition, vacuum deformation of the bottle wall did not occur.

The invention claimed is:

1. A liquid detergent composition, comprising: a surfactant (A) [hereinafter, referred to as component (A)] in an amount of 40 to 80% by mass; a polymer compound (B) described below [hereinafter, referred to as component (B)] in an amount of 0.3 to 8% by mass; and water, wherein component (A) comprises a nonionic surfactant (a1) [hereinafter, referred to as component (a1)] represented by formula (1-1-2), (1-1-4), or (1-1-5) in an amount of 30 to 70% by mass of the composition:

component (a1): a nonionic surfactant represented by formula (1-1-2), (1-1-4), or (1-1-5)

$R^1O\text{-}(EO)_m\text{-}(A'O)_nH$ (1-1-2)

$R^1O\text{-}(EO)_{m1}\text{-}[(A'O)_n.(EO)_{m2}]H$ (1-1-4)

$R^1O\text{-}(EO)_{m1}\text{-}(A'O)_n\text{-}(EO)_{m2}H$ (1-1-5)

wherein, $R^1$ represents a hydrocarbon group having 8 to 22 carbon atoms; an oxygen-bonding carbon atom of $R^1$ in $R^1$—O— is a primary carbon atom; A'O represents an oxypropylene group; m1 and m2 each represent an average addition mole number and m=m1+m2; m and n each represent an average addition mole number, m is a number of 16 to 30 and n is a number of 1 to 5; "•" represents that (A'O) and (EO) are linked randomly;

component (B): a polymer compound having a polyether chain moiety (i) composed of polymerization units derived from an epoxide having 2 to 5 carbon atoms and a polymer chain moiety (ii) composed of polymerization units derived from one or more unsaturated carboxylic acid monomers selected from the group consisting of acrylic acid, methacrylic acid and maleic acid, the polymer compound having a graft structure wherein one of the chain moieties (i) and (ii) is the main chain and the other is a side chain.

2. The liquid detergent composition according to claim 1, wherein component (A) further comprises an anionic surfactant (a2) [hereinafter, referred to as component (a2)] wherein the total content of components (a1) and (a2), (a1)+(a2), is 40 to 80% by mass, and a mass ratio of components (a1) to (a2), (a1)/(a2), is 25/75 to 90/10.

3. The liquid detergent composition according to claim 1, further comprising a water-miscible organic solvent as component (C) in an amount of 5 to 40% by mass.

4. The liquid detergent composition according to claim 1, wherein the content of water is 5% by mass or more.

5. The liquid detergent composition according to claim 1, wherein $R^1$ in formula (1) represents a linear hydrocarbon group.

6. The liquid detergent composition according to claim 1, wherein, in compounds constructing component (a1), a percentage of compounds having an oxyethylene group as the oxyalkylene group bonding to $R^1$—O—, is 75% by mol to 100% by mol.

7. The liquid detergent composition according to claim 1, wherein, in compounds constructing component (a1), a percentage of compounds having an oxyethylene group as the oxyalkylene group bonding to $R^1$—O—, is 80% by mol to 100% by mol.

8. The liquid detergent composition according to claim 1, wherein component (a1) is a nonionic surfactant represented by the following formula (1-1-5):

$R^1O\text{-}(EO)_{m1}\text{-}(A'O)_n\text{-}(EO)_{m2}H$ (1-1-5)

wherein, $R^1$, m, n, EO, and A'O represent the same meanings as above.

9. The liquid detergent composition according to claim 2, wherein the anionic surfactant of component (a2) is (a2)-1, (a2)-2, (a2)-3, or (a2)-4:

(a2)-1: alkylbenzenesulfonic acid salt having an alkyl group of average carbon number of 10 to 20, (a2)-2: polyoxyethylene alkyl ether sulfuric acid ester salt having an average addition mole number of 1 to 5, that has an alkyl group of average carbon number of 10 to 20 derived from a linear primary or secondary alcohol or a branched alcohol and has oxyethylene groups one or two of which may be substituted with oxypropylene groups, (a2)-3: alkyl- or alkenylsulfuric acid ester salt having an alkyl or alkenyl group of average carbon number of 10 to 20, (a2)-4: fatty acid salt of average carbon number of 8 to 20.

10. The liquid detergent composition according to claim 1, wherein component (B) is a polymer compound having chain moiety (i) as the main chain.

11. The liquid detergent composition according to claim 1, wherein component (B) is a polymer compound having chain moiety (ii) as the main chain.

12. The liquid detergent composition according to claim 10, wherein component (B) is a polymer compound obtained by graft-polymerizing an unsaturated monoethylenic monomer including one kind or more of unsaturated carboxylic acid monomer selected from acrylic acid, methacrylic acid and maleic acid on a polyether main chain.

13. The liquid detergent composition according to claim 11, wherein component (B) is a polymer compound produced by copolymerizing a macromonomer previously attached with the polyether chain moiety with an unsaturated monoethylenic monomer(s) including one or more unsaturated carboxylic acid monomers selected from acrylic acid, methacrylic acid and maleic acid, or a polymer compound produced by adding a polymerizable monomer selected from an alkylene oxide and glycidyl ether to a polymer of an unsaturated monoethylenic monomer(s) including one or more unsaturated carboxylic acid monomers selected from acrylic acid, methacrylic acid and maleic acid.

14. The liquid detergent composition according to claim 1, wherein the polyether chain moiety of component (B) is composed of polymerization units including a unit derived from ethylene oxide and/or propylene oxide.

15. The liquid detergent composition according to claim 1, wherein component (B) is a polymer compound composed of two polymerization units represented by formula (B2), being any one of random, alternating, and block polymers, having the chain moiety (ii) as the main chain and the chain moiety (i) represented by formula (B3) as a side chain in the structure of the main chain:

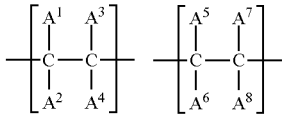

(B2)

wherein, $A_1$ represents a hydrogen atom; $A_2$ represents a hydrogen atom or —$COOX_1$; $A_3$ represents a hydrogen atom or a methyl group; $A_4$ represents —$COOX_2$; with the proviso that the total number of carbon atoms in $A_1$, $A_2$ and $A_3$ is 0 or 1; $X_1$ and $X_2$, each independently or at the same time, represent a hydrogen atom, a mono- or divalent metal atom, an ammonium group or an organic amine group; $A_5$ represents a hydrogen atom; $A_6$ represents a hydrogen atom or —$COOX_1$, $A_7$ represents a hydrogen atom or a methyl group; $A_8$ represents —COO—Z or —$CH_2$—O—Z; with the proviso that the total number of carbon atoms in $A_5$, $A_6$ and $A_7$ is 0 or 1; and Z represents a group of formula (B3);

$$\text{-}(AO)_n\text{—}Y \quad \text{(B3)}$$

wherein, A represents an alkylene groups having 2 to 3 carbon atoms, and a plurality of A may be the same or different; Y represents a hydrogen atom, a methyl group, a phenyl group or a benzyl group; and n is an average added mole number of 10 to 100.

16. The liquid detergent composition according to claim 15, wherein A in component (B) is ethylene group.

17. The liquid detergent composition according to claim 4, wherein the total amount of components (A) to (C) and water is 85% by mass or more of the composition.

* * * * *